United States Patent [19]

Burkard

[11] 3,945,051

[45] Mar. 23, 1976

[54] SHORT PANTS WITH PANEL OVERLAP

[76] Inventor: Eugene R. Burkard, 4534 West Pt. Loma Blvd., San Diego, Calif. 92107

[22] Filed: Nov. 4, 1974

[21] Appl. No.: 520,626

[52] U.S. Cl. ..... 2/224 R; 2/238

[51] Int. Cl.[2] ..... A41B 9/02

[58] Field of Search..... 2/224 R, 224 A, 225, 226, 2/227, 238

[56] References Cited

UNITED STATES PATENTS 1,966,060 7/1934 Cohen ..... 2/224 R

FOREIGN PATENTS OR APPLICATIONS 1,522,492 3/1968 France ..... 2/238

*Primary Examiner*—H. Hampton Hunter

*Attorney, Agent, or Firm*—Brown & Martin

[57] ABSTRACT

Short pants in which the left and right seat panels are independent of the left and right front panels. The left and right seat panels are attached to the waist band at their upper edges and extend over substantially greater than one-half the waistband. The forward edges of the left and right seat panels slant downwardly and rearwardly from the waistband. The left and right front panels overlap the left and right seat panels at the waistband. Their rearward edges extend generally vertically downwardly from the waistband to terminate on the lower edges in the proximity of the edges of the left and right seat panels.

5 Claims, 3 Drawing Figures

SHORT PANTS WITH PANEL OVERLAP

BACKGROUND OF THE INVENTION

Short pants are in wide spread use by both men and women, both as undergarments and for outerwear. Because of compromises between function and appearance outerwear shorts are often specifically designed for a particular type of use, such as shorts designed for walking, for tennis, or for basketball. A comparable conflict exists in the design of underwear. For example, shorts that are intended primarily for use in sports must not restrict free movement of the trunk and legs even if appearance must be sacrificed. On the other hand, underwear shorts, designed for use under dress clothes, should not have excess material to cause bunching and other visible distortions of the outer garment but should not be so tight as to chafe or be restricting. The basic compromise and conflict in design is typified by the two major types of underwear. The vast majority of underwear products sold can be classified as either boxer-type or brief type shorts. Brief type shorts are generally close fitting and frequently have leg openings with elastic. They provide a relatively small area of body coverage and are considered by many men to be constricting and uncomfortable. They must be made of a relatively elastic material such as knit to avoid being unduly restrictive of movement. Boxer-type shorts are generally more loose fitting and provide greater coverage of the male torso. The looseness of the fit is dictated by a need to provide for adequate freedom of movement of the wearers legs without resort to elastic material. For example when the wearers knee is raised the looseness permits sufficient freedom of movement in the leg opening, this looseness produces excess material that may bulge or otherwise distort the wearers outer garments to an undesirable extent. Further, boxer-type shorts have not typically provided any male support; again, because of the requirement for a general loose fitting configuration.

A similar conflict exists in the design of outerwear shorts. For example, in the design of a pair of shorts intended for use as tennis shorts, it is generally considered to be desirable, from a design standpoint to make the shorts conform as closely as possible to the contours of the torso. However, the requirements of the sport for running and knee flexion are such that a garment which conforms too closely to the contours of the torso will be unduly restricting and will interfere with a players performance.

Therefore, it is desirable to have underwear and outerwear shorts that may be made form fitting so as to conform generally to the contours of the torso and which are at the same time not restrictive of movements of the legs and trunk. Such a garment is particularly desirable wherein it is attractive, modest, and may be configured to provide male support.

SUMMARY OF THE INVENTION

The exemplary embodiment of the invention will be described in conjunction with male underwear and outerwear shorts. However, it is to be understood that the garment is equally applicable to women's shorts, and that the description in connection with male garment is not intended as limiting.

The garment according to the exemplary embodiment overcomes the deficiencies of prior art underwear and outerwear shorts and provides a pair of shorts with good wearability, comfort, support, and form-fitting appearance, which at the same time is not restrictive of the wearers movements, and permits substantially the complete range of leg movements without unduly restricting such movements.

The garment generally comprises left and right seat panels which are generally formed of two pieces joined along a line corresponding to a vertical plane intersecting the garment fore and aft. The seat panels have extra material in the central portion of their vertical extent to provide for the curvature of the buttocks, but are restricted along their lower edges to cause the garment to closely conform to the curvature of the torso. The upper edges of the seat panels are joined to a waistband. The seat panels extend on the waistband over substantially greater than one-half of the total circumference of the waistband. The forward edges of the left and right seat panels slope rearwardly and downwardly to join the lower terminal edge of the seat panels. The angulation of the forward terminal edge of the seat panel and the extension of the seat panels over greater than one-half of the waistband produces a upward and forwarding effect on the lower portion of the seat panels, resulting in the seat panels being held in close conformity with the buttocks and upper legs. Such a tensioning effect is exerted over the entire lower edge of the seat panel since it is tapered and terminates rearwardly of the upper seat panel edges.

The tensioning effect is enhanced where the waistband is of an elastic material and therefore the use of such a waistband in conjunction with the embodiments of the invention is preferred. However, the tensioning effect is also present with an unyeilding waistband and the invention is therefore not limited to such use.

The left and right front panels are joined to the seal panels at their lower control extremities to form a crotch portion. The front panels are joined to one another along at least the lower portion of their common vertical edge. The middle portion of their common edge is normally separated by a fly portion. The upper edges of the left and right front panels are secured to the waistband and extend over approximately one-half of the total circumferential extent of the waistband, resulting in an overlap of the frong panels overlying the upper edges of the seat panels. The rearward edge of the left and right front panels extend substantially vertically downwardly from the waistband to the lower edges thereof. Since the rearward edges are substantially vertical the panels do not have a tendency to hang away from the wearer.

The tendency of the front panel to conform to the configuration of the torso is enhanced by the fact that the frontal portion of the torso is substantially more planar over the circumferential extent of the front panels than is the portion covered by the seat panels. Accordingly, it is not necessary to have the same tensioning effect on the front panels as is necessary for the seat. Further, the lesser curvature of the front panel attachment the more this enhances the ease with which the front panel may be pivoted about the waist band as the user raises his leg. The generally vertical aspect of the rearward edge permits such pivoting to take place without pulling or distorting. The front panel is generally free to follow the movement of the legs over a substantial angular range. During knee flexion or raising of the leg there is relatively little requirement for movement in the seat panels inasmuch as the buttocks do not undergo substantial translational movement during such leg action, therefore the tension effect on the rear panels does not produce substantial resistance to movement.

It is to be understood that the seams between the two seat panels, between the front and seat panels and between the panels and waist band may be made integral such as by utilizing a single piece of fabric of the proper shape without departing from the scope of the invention.

It is therefore an object of this invention to provide new and improved short pants with front and seat panel overlap.

It is another object of the invention to provide new and improved short pants that are relatively simple in construction.

It is another object of this invention to provide new and improved short pants that may be configured to closely conform to the torso of the wearer.

It is another object of the invention to provide new and improved short pants that do not substantially limit or restrict freedom of movement of the wearer's legs or trunk.

It is another object of this invention to provide a new and improved short pants that are attractive in overall appearance.

It is another object of the invention to provide a new and improved short pants that may be configured to provide male support without constricted leg openings.

Other objects and many attendant advantages of the invention will become more apparent upon a reading of the following detailed description, together with the drawings in which like reference numerals refer to like parts throughout and in which:

Figure 1:
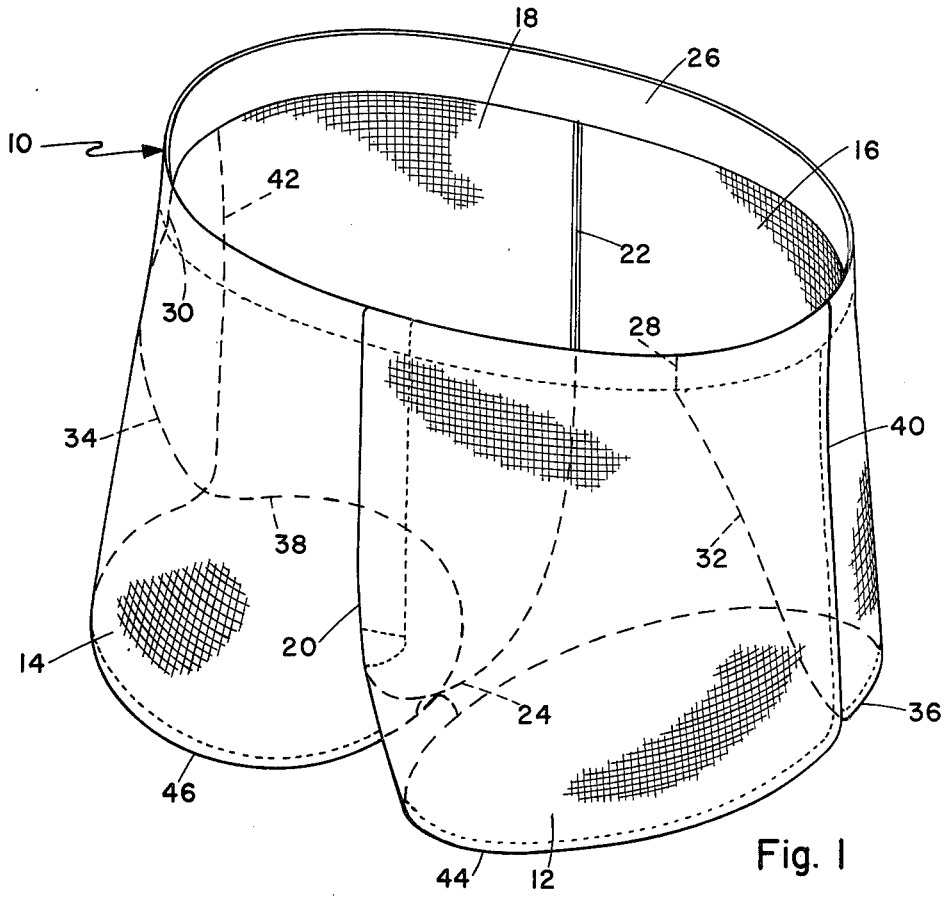
FIG. 1 is a perspective view of short pants according to the invention.

Referring now to the drawings there is illustrated a pair of short pants 10 according to the invention. The pants are comprised of left and right front panels 12 and 14 and left and right seat panels 16 and 18. Front panels 12 and 14 are joined along their lower common edge with a seam 20. The rear panels 16 and 18 are joined along their common edge 22 over substantially the entire vertical extent of the panels. The lower edges 44 and 46 of the front panels 12 and 14 are joined to the lower edges 36 and 38 of the rear panels 16 and 18 at their lower central extremities to form a crotch portion 24.

The seat panels 16 and 18 are joined along their upper edges to the waist encircling waistband 26. The upper edges of the seat panel 16 and 18 extend around substantially in excess of one-half the total circumference of the waistband 26 to terminate at the points 28 and 30. The forward edges 32 and 34 of the seat panels 16 and 18 extend downwardly and rearwardly from the waistband to join the lower edges 36 and 38. The front panels are secured along their upper terminal edges to the waistband 26 and terminate in rearward edges 40 and 42 which extend around the waistband sufficiently to overly a portion of the rear panels 16 and 18. An overlap of two to three inches of extended waistband has been found to be especially advantageous.

Figure 2:
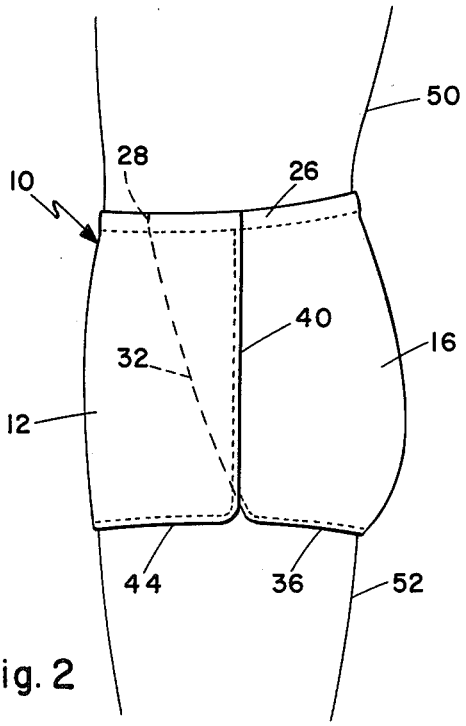
FIG. 2 is a side elevational view of the short pants as worn, with the wearer standing normally.

In the normal configuration illustrated in FIGS. 1 and 2, the rearward edges 40 and 42 are substantially vertical and terminate at the horizontal edges 44 and 46 at a point immediately adjacent to the lower terminus of the forward edge 32 thereby completing the outer portion of the leg openings.

Figure 3:
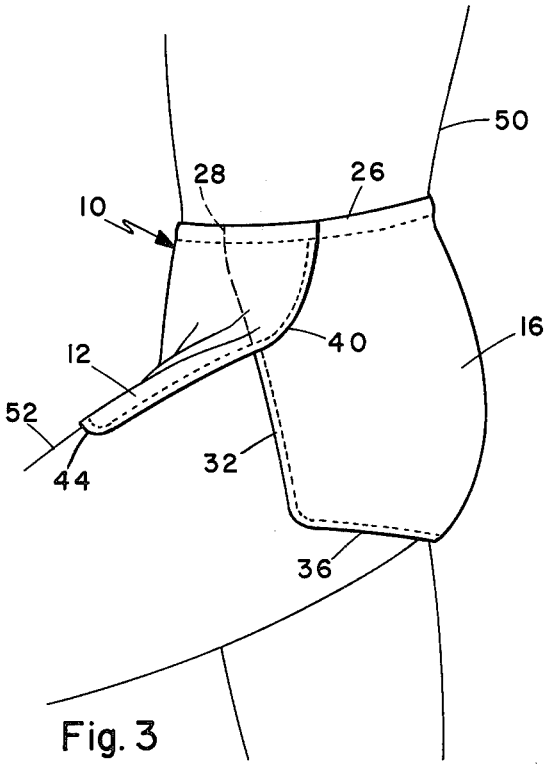
FIG. 3 is a side elevation view similar to FIG. 2 but with the wearers leg in a raised position.

Referring now to FIGS. 2 and 3, the functioning of the garment during leg flexion is illustrated. In FIG. 2, the rearward terminal edge 40 is substantially vertical and overlies a triangular section of the rear seat panels 16 leaving only a small gap near the lower edges. It will be seen that the seat panel 16 is cut closely to conform to the wearer's torso 50 in the area of the buttocks. There is substantially no excess material that in underwear would bulge or otherwise distort outer garments or that would be unattractive in outerwear shorts. In FIG. 3, there is illustrated the configuration of the garment 10 during leg flexion. The rear seat panel 16 is still in close conformity with the buttocks area of the torso 50, since that portion of the anatomy is relatively undistorted by leg movement. However, the front panel 12 is flexed to conform to the positioning of the legs 52 and the flexion is substantially by way of a pivoting or rotating of the panel about the waist band 26 and by flexion of the fabric along its length. Since the front panel 12 does not extend over more than one-half of the waistband there is relatively little resistence to the pivoting action and relatively minor distortion of the material during the flexing action. The primary change in the appearance of the garment is an increase of the size of the opening between the terminal edges 40 and 32 on the front and seat panels respectively.

Having described my invention, I now claim:

1. Short pants comprising:

left and right front panels of flexible fabric, left and right seat panels of flexible fabric, a waist encircling waistband, said seat panels being joined together along a common edge in a vertical plane, said front panels being joined together at least along their lower portions along a common edge in said vertical plane, the lower portions of said front panels and said seat panels being secured together at their lower central extremities forming a crotch portion, said seat panels being joined to said waistband along their upper edges over substantially more than half of the total circumference of said waistband with the front edge of said seat panels being secured to the front portion of said waistband, the front edges of said seat panels extending downwardly and rearwardly from the front of said waistband, said front panels being joined to said waistband along their upper edges along substantially the front half of said waistband and having rear edges that extend substantially beyond and overlie said front edges of said seat panels to form an overlap, and said front panels being free of attachment to said seat panels over at least the lower portion of said overlap.

2. Short pants according to claim 1 wherein, said rear edges of said left and right front panel are substantially vertical in the unflexed configuration.

3. Short pants according to claim 1 wherein, the lower edges of said front panel having an outer terminus that is closely adjacent to the outer terminus of the lower edges of said seat panels.

4. Short pants according to claim 1 wherein, each of said front panels overlap said rear panels by approximately 2 to 3 inches.

5. Short pants according to claim 3 wherein, each of said front panels overlap said rear panels by substantially 2 to 3 inches.

* * * * *